US011001999B2

(12) United States Patent
Betts

(10) Patent No.: US 11,001,999 B2
(45) Date of Patent: May 11, 2021

(54) SHOWER DRAIN ASSEMBLY

(71) Applicant: David Betts, Linden, MI (US)

(72) Inventor: David Betts, Linden, MI (US)

( * ) Notice: Subject to any disclaimer, the term of this patent is extended or adjusted under 35 U.S.C. 154(b) by 0 days.

(21) Appl. No.: 16/390,092

(22) Filed: Apr. 22, 2019

(65) Prior Publication Data

US 2019/0330835 A1 Oct. 31, 2019

(51) Int. Cl.
*E03F 5/04* (2006.01)

(52) U.S. Cl.
CPC ..... *E03F 5/0408* (2013.01)

(58) Field of Classification Search
CPC ..... E03F 5/0408
USPC ..... 4/679, 584, 613
See application file for complete search history.

(56) References Cited

U.S. PATENT DOCUMENTS 3,283,340 A * 11/1966 McMartrie ..... A47K 3/16 4/584
3,774,631 A * 11/1973 Willkins ..... F16L 1/10 137/357
4,221,441 A * 9/1980 Bain ..... A47K 4/00 312/228
4,287,618 A * 9/1981 Silver ..... E03D 9/085 4/420.2
4,919,164 A * 4/1990 Barenburg ..... E03C 1/01 137/15.08
5,076,310 A * 12/1991 Barenburg ..... E03C 1/01 137/15.08
5,210,886 A * 5/1993 Coe ..... E03B 1/04 4/665
5,309,582 A * 5/1994 Henkin ..... E03C 1/00 4/596
7,063,098 B2 * 6/2006 Sprague ..... E03B 7/006 137/15.04
9,949,598 B2 * 4/2018 Masecchia ..... A47K 4/00
2008/0196161 A1 * 8/2008 Ball ..... E03C 1/232 4/680
2015/0152627 A1 * 6/2015 Ball ..... E03C 1/24 4/680
2016/0369483 A1 * 12/2016 Wade ..... C02F 1/006
2019/0104890 A1 * 4/2019 Braddock ..... G05D 7/00

* cited by examiner

*Primary Examiner* — Lori L Baker
(74) *Attorney, Agent, or Firm* — GrayRobinson, P.A.

(57) ABSTRACT

An apparatus and method for plumbing a conventional bathtub drain to a conventional shower drain. A wooden framework is used wherein a pipe is placed that has one end connected to a pre-existing bathtub drain and the other end connected to a shower stall drain. The framework requires a minimal height because the pipe is oval shaped, thus providing a large enough volume for fluid flow while limiting the height required for such a pipe.

12 Claims, 4 Drawing Sheets

SHOWER DRAIN ASSEMBLY

CROSS-REFERENCE TO RELATED APPLICATIONS

This application claims priority to provisional application No. 62/662,484, filed on Apr. 25, 2018, the disclosure of which is hereby incorporated by reference herein.

BACKGROUND OF THE INVENTION

Field of the Invention

This invention relates to bathtub-to-shower conversions. More particularly, this invention relates to an apparatus and method for plumbing a conventional bathtub drain to a conventional shower drain.

Description of the Background Art

During the construction of a bathroom in a home, a bathtub drain is provided to allow the installation of a bathtub. Typically, the bathtub drain is plumbed from the sewer drain running underneath the house to a conventional location inside the house a few inches from a wall structure. The bathtub is then installed with its drain directly plumbed to the bathtub drain.

Oftentimes during remodeling of the home, it is desirable to convert a bathtub to a shower stall. However, drains in shower stalls are typically located in the center of the shower stall appreciably away from the bathtub drain and therefore cannot be directly connected to the bathtub drain.

One solution is to redesign the shower stall to locate its drain over the bathtub drain so that it can be directly plumbed to it. This solution necessarily requires a new manufacturing mold for the shower stall, thereby dramatically increasing the costs to the homeowner.

Another solution has been to relocate the bathtub drain from the sewer liner to the desired center of the shower stall to be installed. This economically allows conventional center-drain shower stalls to be used.

Some houses are constructed on a floor structure constructed of joists such that relocating the bathtub drain is easily done. However, some houses, particularly in Florida, are constructed on a concrete slab poured after all the plumbing is installed. In slab-constructed homes, subsequently relocating a bathtub drain is a difficult task because the concrete slab around the bathtub drain has to be chipped out to make a void for the new plumbing to be installed for the center-drain shower stall. After the new plumbing is installed for the center-drain shower stall, new concrete must be poured to fill-in the void.

One work-around for relocating a bathtub drain to a center-drain shower stall in a concrete-slab house, has been to build a raised floor about the concrete slab to a height sufficient to allow new plumbing to run from the bathtub drain to the intended center of the shower stall.

As shown in FIG. 1, a wooden framework 10 of joists is constructed above the concrete slab 66 to create the raised floor. Conventional plumbing fittings (e.g., 2' PVC pipe 12 and two 2" PVC 90° elbows 14B and 14S) are assembled to interconnect the conventional bathtub drain 16 with a shower stall drain 18. The shower stall 20 may then be installed on top of the raised framework 10 while its conventional shower pan drain is connected to the 90° elbow 14S.

Unfortunately, at shown in FIG. 1, by utilizing conventional plumbing components, the raised framework 10 results in raising the height of the shower stall 20 an appreciable distance (e.g., 10 inches), necessitating a high step-up or step-down during ingress or egress in the shower stall 20. Stepping up too high to get into the shower stall 20 or having to step down too far to get out of the shower stall 20 is undesirable, particularly for the elderly population whose mobility may be impaired.

Therefore, it is an object of this invention to provide an improvement which overcomes the aforementioned inadequacies of the prior art methods and devices for converting a bathtub to a shower stall.

Another object of this invention is to provide an apparatus and method that facilitates replacing a conventional bathtub with a conventional shower stall having a center drain.

Another object of this invention is to provide an apparatus and method for converting a bathtub to a shower stall while minimizing the height of the raised framework 10 so as to minimize the height of the step-up or step-down required in order to get into or out of the shower stall.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention comprises an apparatus and method for plumbing a conventional bathtub drain to a conventional shower drain allowing a conventional bathtub to be replaced by a conventional shower stall having a center drain.

More particularly, the plumbing assembly of the invention comprises a first pipe elbow for connection to the conventional bathtub drain, a second pipe elbow for connection to the center drain of a conventional shower stall, and a length of pipe interconnecting the pipe elbows.

The length of pipe comprises an oval cross-sectional configuration. Correspondingly, the respective ends of the pipe elbows also comprise a corresponding oval cross-sectional configuration to allow the oval pipe to be inserted therein and solvent glued for water-tightness. Furthermore, the angle of the elbows may be somewhat greater than 90° to impart a gradual upward slope in the pipe from the bathtub drain to the center drain of a conventional shower stall. The shower stall elbow includes a support standoff extending downwardly at distance substantially equal to the increased height of the shower stall elbow over the bathtub drain elbow due to the upward slope of the pipe. The support standoff is seated onto the concrete slab to support the shower stall elbow. It is noted that prior to assembly with the elbows, the length of the pipe may be trimmed to precisely fit the distance between the bathtub drain and the center drain of the shower stall. It is also noted that the raised framework 10 surrounds the piping assembly of the invention to create a support for the shower stall to be installed thereon.

The oval cross-sectional configurations of the pipe and the respective ends of the elbows achieve a low-profile when assembled together such that the height of the raised framework 10 may be appreciably reduced (e.g., reduced from about 10 inches to less than 5 inches), thereby minimizing the height of the step-up and step-down into the shower stall during ingress or egress.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several figures.

DETAILED DESCRIPTION OF THE PREFERRED EMBODIMENT

Figure 1:
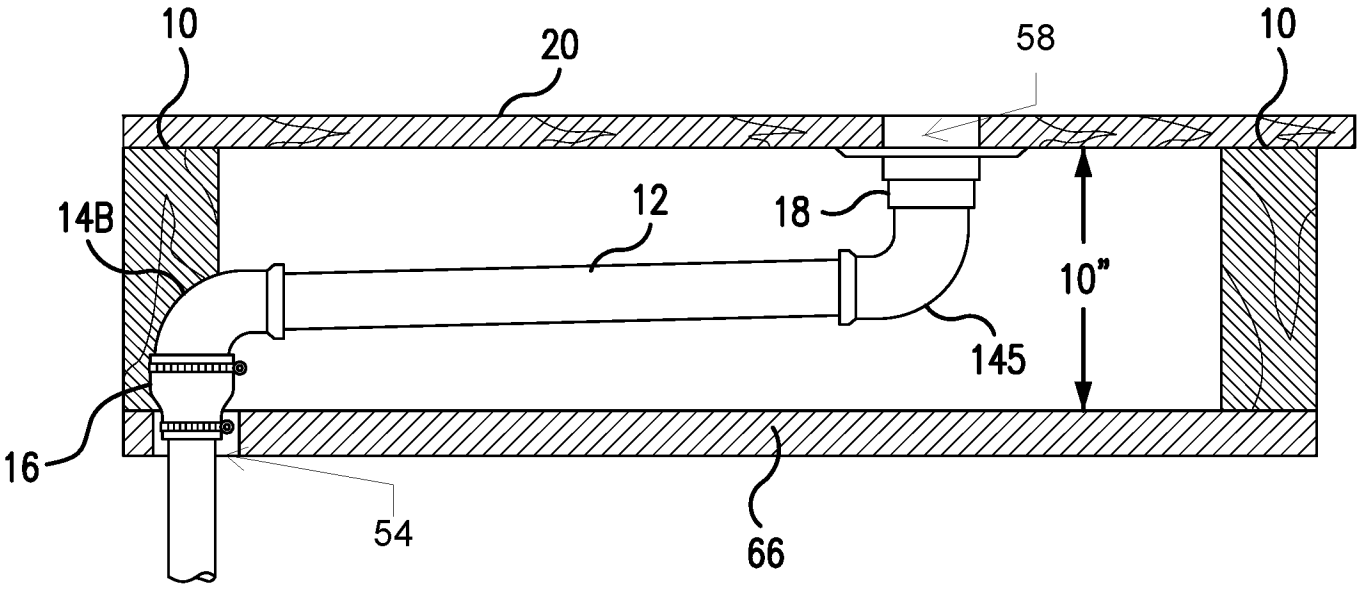
FIG. 1 PRIOR ART
FIG. 1 is side elevational view of a prior art plumbing assembly showing the placement of the raised framework 10.
Figure 2:
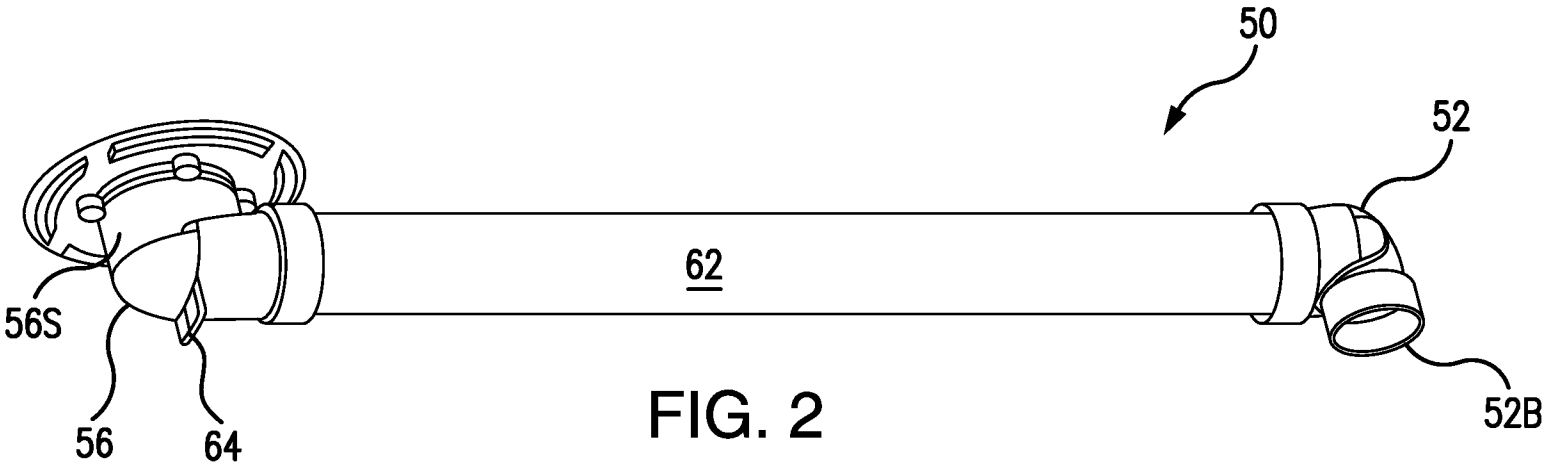
FIG. 2 is a top perspective view of the plumbing assembly of the invention.
Figure 3:
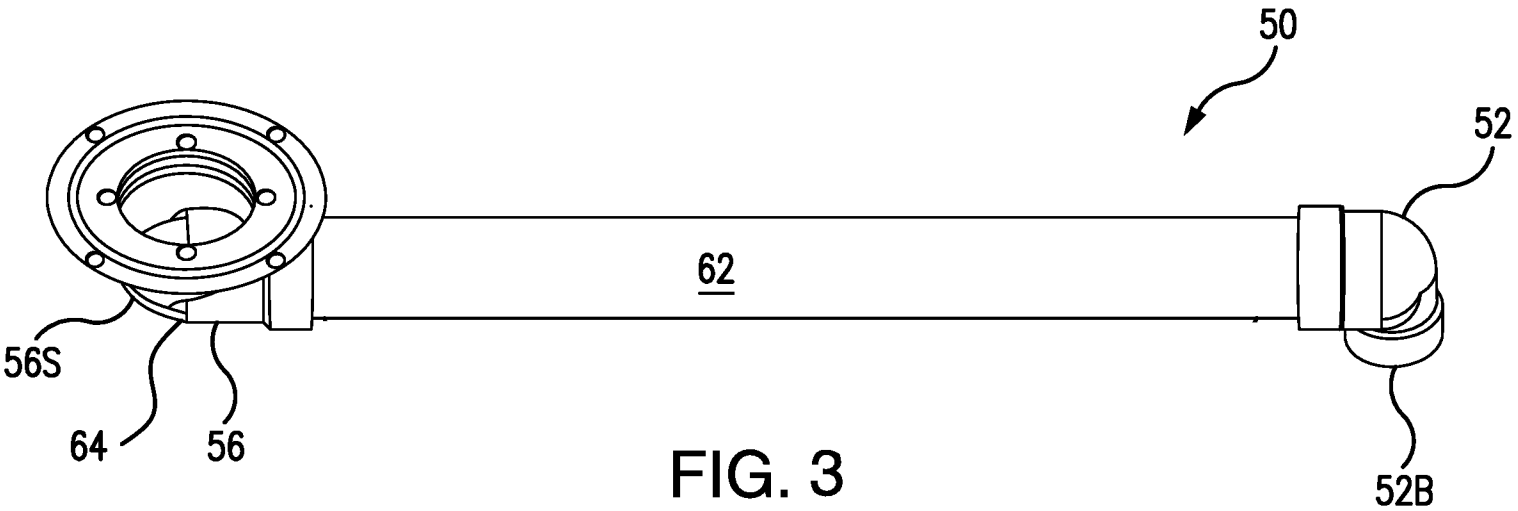
FIG. 3 is a bottom perspective view of the plumbing assembly of the invention.
Figure 4:
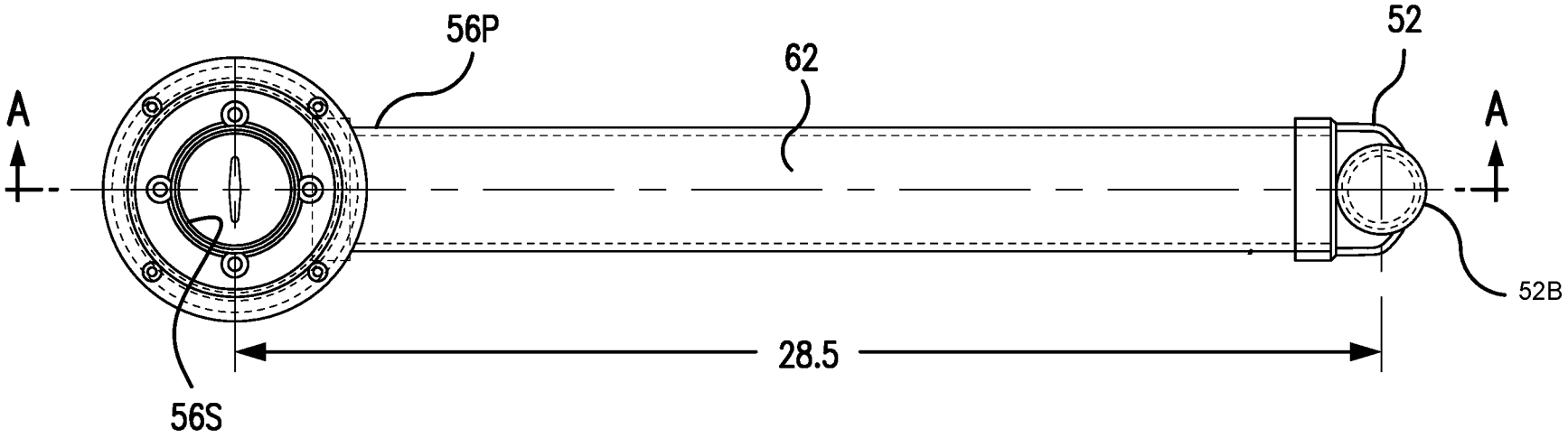
FIG. 4 is a top plan view of the plumbing assembly of the invention.
Figure 5:
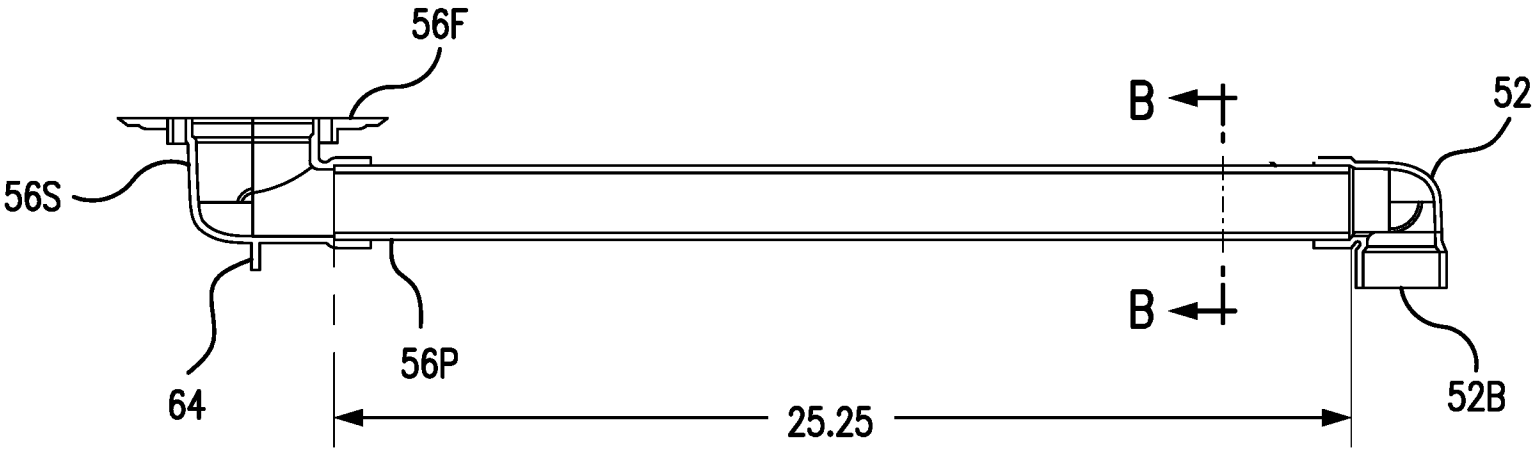
FIG. 5 is a cross-sectional view of FIG. 4 along lines 5-5.

As shown in FIGS. 1-7, the plumbing assembly 50 of the invention comprises a bathtub drain elbow 52 having a downwardly-extending bathtub drain end 52B sized to fluidly couple to an existing conventional bathtub drain 54, a shower stall drain elbow 56 having an upwardly-extending shower stall drain end 56S sized to fluidly couple to a center drain 58 of a conventional shower stall 60 via a pipe flange 56F and a length of pipe 62 sized to fluidly extend between the pipe ends 52P and 56P of the respective elbows 52 and 56.

Figure 6:
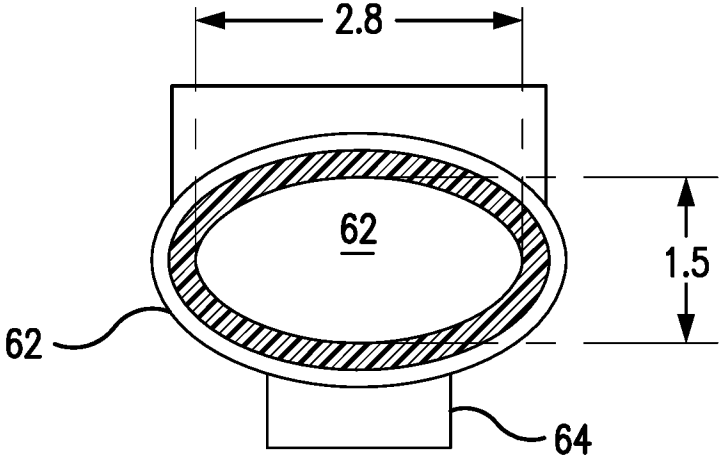
FIG. 6 is a cross-sectional view of FIG. 4 along lines 6-6.

As best shown in FIG. 6, the length of pipe 62 comprises a low-profile oval cross-sectional configuration (e.g., 1.68" high compared to 2.98" wide). Correspondingly, the pipe ends 52P and 56P of the respective elbows 52 and 56 have the same low-profile oval cross-sectional configuration of the pipe 62 allowing the ends of the pipe 62 to be inserted into and solvent-welded to the respective elbows 52 and 56 to establish a fluid-tight connection.

Each of the respective elbows 52 and 56 is preferably injected molded at an angle slightly greater than 90 degrees (e.g., 92 degrees) to define an upward slope (e.g., 1.2 inches per foot) in the pipe 62 extending from the conventional bathtub drain 54 to the center drain 58 of the shower stall 60. Further, the shower stall drain elbow 56 preferably comprises an integrally-formed support standoff 64 depending therefrom and having a flat planar configuration and a length sufficient to be seated onto the concrete slab 66 of the house to provide support the shower stall drain elbow 56 due to the upward slope of the pipe 62.

Figure 7:
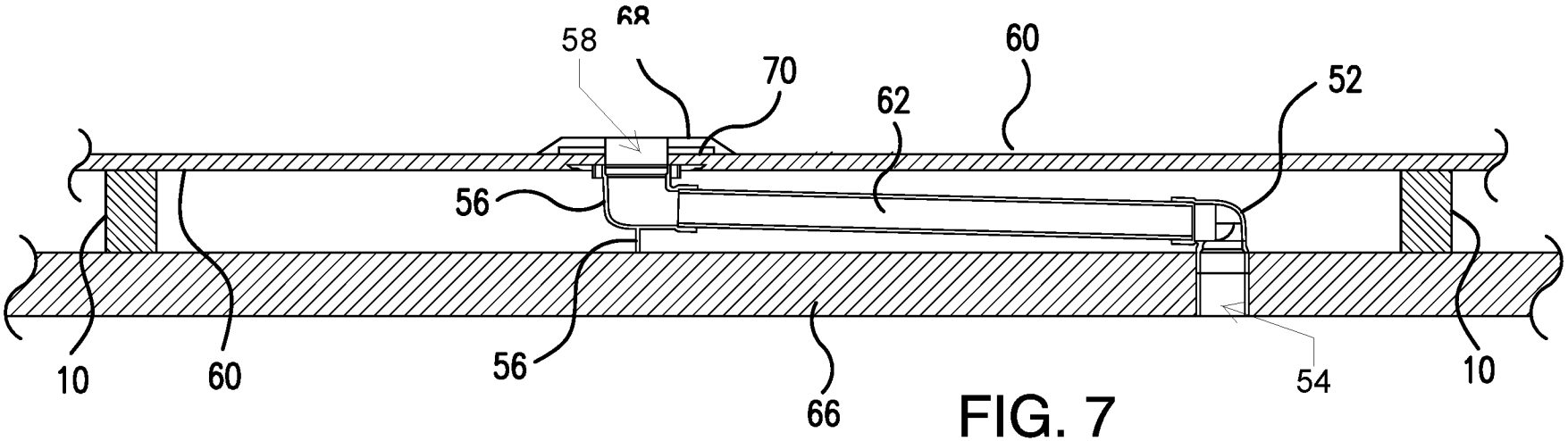
FIG. 7 is a partial cross-sectional view showing the retrofit replacement of a bathtub with a shower stall utilizing the plumbing assembly of the invention.

Referring now to FIG. 7, the method of the invention comprises constructing the wooden framework 10 on the concrete slab 66, the framework 10 comprising a plurality of joists at a level substantially equal to the height of the pipe flange 56F. After trimming the length of the pipe 62, the respective ends of the pipe 62 are solvent-welded into the pipe ends 52P and 56P of the respective elbows 52 and 56. The downwardly-extending bathtub drain end 52B of the bathtub drain elbow 52 is solvent-welded into the existing conventional bathtub drain 54 in an orientation directed to the intended location of the center drain 58 of a conventional shower stall 60. The pipe flange 56F is likewise solvent-welded onto the upwardly-extending shower stall drain end 56S of the shower stall drain elbow 56.

The conventional shower stall 60 is installed onto the wooden framework 10 and affixed in place according to its installation instructions. With the pipe flange 56F of the upwardly-extending shower stall drain end 56S of the shower stall drain elbow 56 in alignment, the shower stall's drain grill 68 and gasket 70 may be installed onto the pipe flange 56F to create a water-tight connection between the floor of the shower stall 60 and the pipe flange 56F.

It should be appreciated that the plumbing assembly 50 of the invention appreciably reduces the height of the wooden framework 10 by as much as one-half or more, thereby significantly reducing the height of the step for ingress or egress from the shower stall 60.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. A plumbing bathtub-to-shower conversion kit for converting a conventional bathtub installed onto a slab of a building and plumbed to a conventional bathtub drain to be converted to a conventional shower stall by plumbing said bathtub drain to a centrally-located shower stall drain of the shower stall to be installed, the shower stall drain being positioned higher above than the bathtub drain, comprising in combination:

a framework installed onto the slab after removal of the bathtub for supporting the conventional shower stall once installed, the shower stall drain being positioned higher than the bathtub drain;

an oval pipe having a first end fluidly connected to a first elbow and a second end fluidly connected to a second elbow, said pipe and elbows positioned at in incline angle within said framework extending between the lower bathtub drain and the higher shower stall drain once installed; said pipe being configured to have an oval cross section with a horizontal dimension wider than a vertical dimension;

said first elbow comprising a shower stall drain end for connection to the drain of the shower stall;

a support standoff emanating relative to said first elbow for supporting said pipe onto the slab; and said second elbow comprising a bathtub drain end for connection to the bathtub drain, whereby after removal of the bathtub, construction of said framework, installation of said oval pipe and fluidly interconnecting said second elbow to the bathtub drain, the shower stall is installed with the first elbow fluid interconnecting the shower stall drain with said pipe with standoff being supported by the slab.

2. The kit of claim 1 wherein said pipe is composed of polyvinyl chloride.

3. The kit of claim 1 wherein said framework is composed of wood.

4. The kit of claim 1 wherein said first and second elbows are configured to have an angle greater than 90 degrees.

5. A bathtub-to-shower conversion method of converting a conventional bathtub drain emanating from a slab of a building into a conventional shower drain, comprising the steps of:

removing the existing bathtub including disconnecting the bathtub from the bathtub drain emanating from a slab;

constructing a framework on the slab positioning an oval pipe within the framework, the pipe having a first end fluidly connected to a first elbow and a second end fluidly connected to a second elbow, said pipe and elbows positioned at in incline angle within said framework extending between the lower bathtub drain and the higher shower stall drain once the shower stall is installed; said pipe being configured to have an oval cross section with a horizontal dimension wider than a vertical dimension;

said first elbow comprising a shower stall drain end for connection to the drain of the shower stall;

a support standoff emanating relative to said first elbow for supporting said pipe onto the slab; and said second elbow comprising a bathtub drain end for connection to the bathtub drain, whereby after removal of the bathtub, construction of said framework, installation of said oval pipe and fluidly interconnecting said second elbow to the bathtub drain, the shower stall is installed with the first elbow fluid interconnecting the shower stall drain with said pipe with standoff being supported by the slab.

6. The method of claim 5 wherein the pipe is composed of polyvinyl chloride.

7. The method of claim 5 wherein the framework is composed of wood.

8. The method of claim 5 wherein the first and second elbows are 2 configured to have an angle greater than 90 degrees.

9. A plumbing apparatus for converting a conventional bathtub installation fluidly connected to a conventional bathtub drain to a conventional shower stall whose centrally-located shower stall drain is fluidly connected to the bathtub drain, comprising:

a framework installed onto the slab after removal of the bathtub for supporting the conventional shower stall once installed, the shower stall drain being positioned higher than the bathtub drain, an oval pipe having a first end fluidly connected to a first elbow and a second end fluidly connected to a second elbow, said pipe and elbows positioned at in incline angle within said framework extending between the lower bathtub drain and the higher shower stall drain once installed, said pipe being configured to have an oval cross section with a horizontal dimension wider than a vertical dimension;

said first elbow comprising a shower stall drain end for connection to the drain of the shower stall;

a support standoff emanating relative to said first elbow for supporting said pipe onto the slab;

said second elbow comprising a bathtub drain end for connection to the bathtub drain; and whereby after removal of the bathtub, construction of said framework, installation of said oval pipe and fluidly interconnecting said second elbow to the bathtub drain, the shower stall is installed with the first elbow fluid interconnecting the shower stall drain with said pipe with standoff being supported by the slab.

10. The apparatus of claim 9 wherein said pipe is composed of polyvinyl chloride.

11. The apparatus of claim 9 wherein said support member is composed of polyvinyl chloride.

12. The apparatus of claim 9 wherein said first and second elbows are configured to have an angle greater than 90 degrees.

* * * * *